United States Patent [19]

Yokomori et al.

[11] Patent Number: 4,557,366

[45] Date of Patent: Dec. 10, 1985

[54] COIN SORTER

[75] Inventors: Shinji Yokomori; Yoshio Ushijima, both of Nagano, Japan

[73] Assignee: Fuji Electric Company, Kanagawa, Japan

[21] Appl. No.: 536,902

[22] Filed: Sep. 28, 1983

[30] Foreign Application Priority Data

Sep. 28, 1982 [JP] Japan ..... 57-169271

[51] Int. Cl.[4] ..... G07D 5/08

[52] U.S. Cl. ..... 194/100 A; 324/DIG. 1

[58] Field of Search ..... 194/99, 100 R, 100 A; 324/DIG. 1

[56] References Cited

U.S. PATENT DOCUMENTS

| | | | |
|---|---|---|---|
| 3,749,220 | 7/1973 | Tabiichi et al. | 194/100 A |
| 3,870,137 | 3/1975 | Fougere | 194/100 A |
| 4,206,775 | 6/1980 | Tanaka | 194/100 A X |
| 4,326,621 | 4/1982 | Davies | 194/100 A |
| 4,405,895 | 9/1983 | Gerst et al. | 324/DIG. 1 |

*Primary Examiner*—F. J. Bartuska

*Attorney, Agent, or Firm*—Brumbaugh, Graves, Donohue & Raymond

[57] ABSTRACT

A coin sorter has an AC bridge circuit including at least one bridge arm having a detecting coil disposed along a coin passage to detect a plurality of coin denominations. A reactance element, such as a fixed coil or capacitor, is connected in a second arm of the bridge, and a plurality of resistors connected in series are provided in a third arm of the bridge for obtaining fractions of the voltage developed across said third arm in response to the passage of different coins. Differential amplifiers receive the voltages from different taps between the resistors and compare these voltages with a voltage proportional to the voltage across the reactance element. The outputs of the differential amplifiers provide an indication of the coin denomination.

6 Claims, 8 Drawing Figures

COIN SORTER

BACKGROUND OF THE INVENTION

This invention relates to a coin sorter for use in a vending machine or the like and, more particularly, to a coin sorter having a bridge circuit for examining the genuineness and kinds of coins inserter in the sorter.

One type of known coin sorter for use in a vending machine has a coin detecting coil that is disposed along a passage through which inserted coils roll on. The detecting coil is connected to one arm of a bridge circuit and fed with an AC voltage. An example of this prior art coin sorter is shown in FIG. 1, in which an AC bridge circuit 1 has arms comprising a coin detecting coil SC, fixed resistors $R_{10}$ and $R_{11}$, and a variable resistor $R_{12}$ plus a variable coil $L_{11}$, respectively. The coil SC produces an alternating magnetic field by being supplied with an AC voltage of a constant frequency from an oscillator O, which is connected between power terminals A and B of the bridge circuit 1. The detecting coil is shown consisting of an equivalent reactance $L_0$ and an equivalent resistance $R_0$. Connected in parallel with the bridge circuit 1 is a semi-bridge circuit 2 which consists of a fixed resistor $R_{21}$, a variable resistor $R_{22}$ and a variable coil $L_{21}$. Since the resistances of the variable resistors $R_{12}$, $R_{22}$ of the circuits 1, 2 and the reactances of the variable coils $L_{11}$, $L_{12}$ of these circuits are adjusted so as to assume different values, respectively, this sorter is capable of separating coins into two different types. The output terminals C and $E_1$ of the bridge circuit 1 and the output terminals C and $E_2$ of the circuit 2 are connected to differential amplifiers 3 and 4, respectively, which are connected to the comparison inputs of comparator circuits 7 and 8, respectively, via rectifier circuits 5 and 6, respectively.

As known in the prior art, the bridge circuit is set such that it changes from balanced state to unbalanced state once because of a change in the reactance of the coin detecting coil SC which takes place when an acceptable coin passes the coil SC. This is next illustrated by referring to vector diagram of FIG. 2 showing changes in voltages appearing at terminals A, B, C and D of the bridge circuit 1.

Referring to FIG. 2, A, B, C and D indicate the potentials at terminals A through D, respectively, of the AC bridge circuit 1 of FIG. 1. Where the system is ready for insertion of a coin in standby state, when a predetermined voltage $V_0$ is applied between the terminals A and B of the bridge circuit 1, the voltage potential at point D, between the equivalent reactance $L_0$, and the equivalent resistance $R_0$ of the coil SC, and the voltage potential at the terminal C, between the resistance $R_0$ and the fixed resistor $R_{10}$, are shown at points D and C, respectively, of FIG. 2, because reactance leads resistance by a phase angle of 90°.

If a coin of a first kind, for example, a ten cent coin, is placed at the position of the coil SC, the reactance of the coil SC varies in response to the coin and so the potentials at the terminals C and D change to $C_{01}$ and $D_{01}$, respectively. If a coin of a second kind such as a twenty-five cent coin is placed at the position of the coil SC, the potentials at the terminals C and D change to $C_{02}$, and $D_{02}$, respectively, because the reactance of the coil SC varies differently from the case of the ten cent coin on account of its different characteristics, including the coin material composition, diameter and thickness.

In this way, the reactance of the detecting coil SC changes in response to the characteristics of different coins. Therefore, the variable resistors $R_{12}$, $R_{22}$ and variable coils $L_{11}$, $L_{12}$ of the circuits 1, 2 are individually adjusted so that the potential at terminal $E_1$ of the bridge circuit 1 assumes the voltage at point $C_{01}$ of FIG. 2 and so that the potential at terminal $E_2$ of the bridge circuit 2 assumes the voltage at point $C_{02}$ of FIG. 2, and so that the bridge circuit 1 reaches its balanced state once when the ten cent coin passes the coil SC, while the bridge circuit 2 attains its balanced condition once when the twenty-five cent coin passes across the coil SC, for example.

Accordingly, when the bridge circuits 1 and 2 are balanced, the respective differential amplifiers 3 and 4 or rectifier circuits 5 and 6 deliver a zero output, which is used to examine the genuineness of each coin introduced. For this purpose, when the comparison inputs to the comparator circuits 7 and 8 do not reach their respective reference values $COM_1$ and $COM_2$, their respective comparators 7 and 8 deliver a single pulse.

Although the aforementioned coin sorter used in a conventional apparatus is able to examine the genuineness of each coin introduced and the kinds of accepted coins by making use of the balance state of each bridge circuit, the number of the semi-bridge circuits 2 must be increased with the number of different coins to be detected. This arrangement also requires that a countermeasure be provided to prevent mutual induction between the variable coils of each semi-bridge circuit. In addition, in cases where the coin detecting coils SC have different characteristics, very cumbersome operations are necessary to adjust all of the variable resistors and variable coils.

SUMMARY OF THE INVENTION

Accordingly, it is the object of the present invention to provide an apparatus which overcomes the difficulties associated with the prior art apparatus and which is capable of examining the genuineness of a plurality of coin types and separating the coins into the different denominations simply by means of one AC bridge circuit.

This object is achieved in accordance with the teachings of the present invention by providing a coin sorter having an AC bridge circuit including a first detecting coil arm that has a detecting coil disposed along a coin passage to detect a plurality of kinds of coins for sorting the coins. More specifically, the coin sorter further comprises a reactive element, such as a fixed coil or capacitor, connected into the bridge circuit in a second arm of the bridge, a plurality of resistors connected in a third arm for obtaining fractions of the voltage developed across said third arm in response to the kinds of the coins received in the coin passage, and differential amplifiers corresponding to the respective kinds of coins to be detected, each of the amplifiers comparing the voltage obtained from the associated tap between the resistors with a voltage proportional to the voltage across the reactance element, and wherein the amplification factors of the differential amplifiers or the magnitude of the voltage obtained across the reactance element are determined according to the characteristics of each coin to be accepted.

Thus, it is possible to separate coins received into different denominations by using only one AC bridge circuit without semi-bridge circuits. Further, since the system is lightly loaded, its oscillator can be held to a lower output power level, and the waveforms produced during operation will not be distorted.

Other objects and advantages will become apparent from the detailed description, attached claims and accompanying drawings.

DETAILED DESCRIPTION OF THE PREFERRED EMBODIMENT

Figure 1:
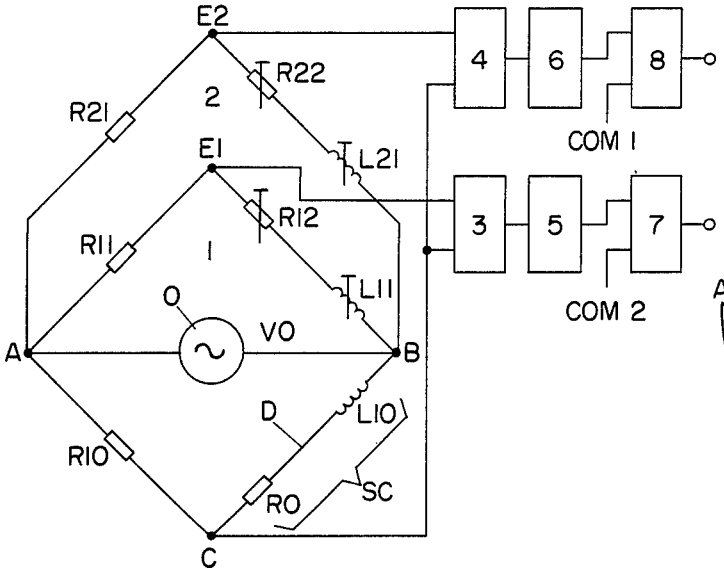
FIG. 1 PRIOR ART
FIG. 1 is a circuit diagram of a conventional coin sorter AC bridge circuit.
Figure 2:
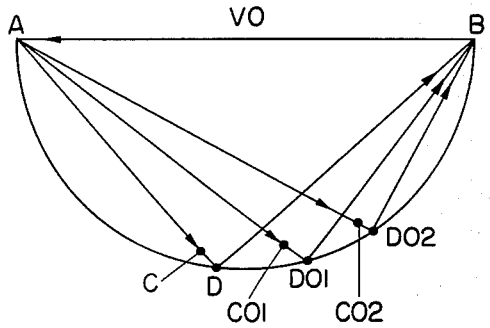
FIG. 2 is a voltage vector diagram illustrating the operation of the FIG. 1 circuit.
Figure 3:
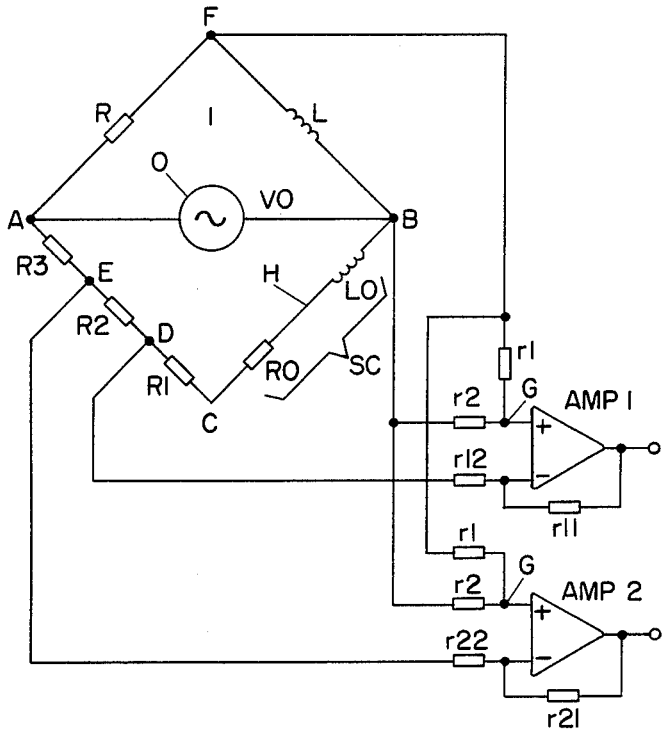
FIG. 3 is a circuit diagram of the AC bridge circuit of one embodiment of the present invention.

One embodiment of the present invention to be described is illustrated in FIG. 3, which shows AC bridge circuit for separating coins into two kinds according to the invention.

Referring to FIG. 3, the AC bridge circuit 1 consists of coin detecting coil SC, fixed resistors $R_1$, $R_2$ and $R_3$, a reference resistor R and a fixed coil L. The detecting coil is disposed along a passage (not shown) through which coins roll on. The detecting coil is represented by an equivalent reactance $L_0$ and equivalent resistance $R_0$. An oscillator O for applying an AC voltage of a constant frequency to the bridge circuit 1 is connected between power supply terminals A and B. Differential amplifiers $AMP_1$ and $AMP_2$ have reference input terminals which receive the voltage between terminals F and B after being divided down to certain values by resistors $r_1$ and $r_2$. The amplifers $AMP_1$ and $AMP_2$ also have comparison input terminals which receive, through resistors $r_{12}$ and $r_{22}$, voltages appearing at respective terminals D and E located at the junctions of neighboring resistors $R_1$, $R_2$ and $R_3$. Feedback resistors $r_{11}$ and $r_{12}$ couple the respective output terminals of the amplifiers to the respective comparison input terminals.

Figure 4:
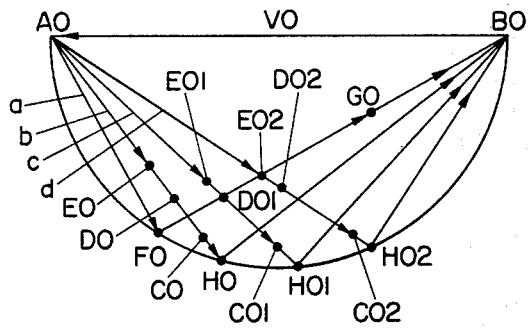
FIG. 4 is a voltage vector diagram illustrating the operation of the FIG. 3 circuit.

Referring to the vector diagram of FIG. 4, there is shown a voltage distribution relative to voltage V0 applied between terminals A and B. The potentials at terminals A through H of FIG. 3 are indicated by A0 through H0, respectively.

Vector a composed of A0, F0 and B0 indicates a vector through terminals A, F and B. The potential at point $F_0$ always remains constant, because the resistance of the fixed resistor R and the reactance of the coil L are constant. G0 on line segment B0-F0 indicates a potential at terminal G which is a fraction of the voltage between the terminals B and F by the dividing action of the resistors $r_1$ and $r_2$. The line segments G0-F0 and B0-G0 correspond to the resistance ratios of the resistors $r_1$ and $r_2$, respectively.

Vector b composed of line segments A0-H0-B0 indicates a vector through terminals A, C and B in a standby state where no coin is present near the position of the coin detecting coil SC. The potential at the junction H of the equivalent reactance $L_0$ and the equivalent resistance $R_0$ of the detecting coil SC is indicated by H0.

Vector c comprised of line segments A0-$H0_1$-B0 indicates a vector through the terminals A, C and B when a coin of a first kind such as a ten-cent coin is present next to the detecting coil SC and the reactance of the coil SC undergoes a change in response to the characteristics of the coin including the material, diameter and thickness. At this time, the potential at the terminal C changes to $C0_1$.

Lastly, vector d comprised of line segments A0-$H0_2$-B0 indicates a vector through the terminals A, C and B when a coin of a second kind such as a twenty-five cent coin is present next to the coil SC and the reactance changes to a value different from the value obtained in the case of the first, or ten-cent coin in response to the characteristics of the coin such as the material, diameter and thickness, so that the potential at the terminal C changes to $C0_2$.

Resistors $R_1$, $R_2$ and $R_3$ are selected so that the potential at the terminal D corresponding to the voltage between the terminals B and D and the potential at the terminal E corresponding to the voltage between the terminals B and E are located at respective points $D_0$ and $E_0$ on the vector B shown in FIG. 4 under a standby condition in which no coin is present near the detecting coil SC. When a coin of the first kind is placed at the position of the coil SC, the potentials are shifted from the points $D_0$ and $E_0$ on the vector b to respective points $D_{01}$ and $E_{01}$ on the vector c. When a coin of the second kind is placed at the position of the coil SC, the potentials are moved from the points $D_0$ and $E_0$ on the vector d.

As can be seen from FIG. 4, both the potential at the terminal D when a coin of the first kind is situated at the position of the coil SC, that is, the point $D_{01}$ on the vector c, and the potential at the terminal E when a coin of the second kind is located at the position of the coil, that is, the point $E_{02}$ on the vector d, lie on the line segment B0-F0 on the vector a. This means that the voltage produced across the coil L and between the terminals B and F of FIG. 3, the voltage set up between the terminals B and D and across the equivalent reactance $L_0$ of the detecting coil SC, and the voltage induced between the terminals B and E and across the reactance $L_0$ are all in phase, although having different amplitudes. Accordingly, the voltages at points $D_{01}$ and $E_{02}$ on the respective vectors c and d intersecting the line segment B0-F0 on the vector a produce no voltage difference attributable to phase difference. Therefore, the output from the amplifier $AMP_1$ is made nil by shifting the point $D_{01}$ on the vector d, which is obtained when a coin of the first kind is present near the coil SC, to the point $G_0$ on the line segment B0-F0, the point $G_0$ resulting from the voltage between the terminals B and F through the voltage-dividing action of the resistors $r_1$ and $r_2$. Also, the output from the amplifier $AMP_2$ is decreased to zero by moving the point $E_{02}$ on the vector d, which is derived when a coin of the second kind is located at the position of the coil SC to the point $G_0$ on the line segment B0-F0.

Consequently, the first requirement of this embodiment is that the resistors $R_1$, $R_2$ and $R_3$ are connected to the arm opposite to the reactor L and that the values of these resistors are selected so that the point $D_0$ on the vector b is moved to the point $D_{01}$ on the vector c when a coin of the first kind is present near the coil SC and the point $E_0$ on the vector b is shifted to the point $E_{02}$ on the vector d when a coin of the second kind is present near the coil SC. The second requirement is that the points $D_{01}$ and $E_{02}$ on the vectors c and d, respectively, are shifted to the point $G_0$.

Describing the first requirement in greater detail, it is first assumed that the total resistance of the resistors $R_1$, $R_2$ and $R_3$ is $$R_1+R_2+R_3=R_4$$

The values of the resistors $R_1$, $R_2$ and $R_3$ can be found by obtaining each ratio of these resistances to the total resistance $R_4$, namely:

$$\frac{D01\ C01}{A0\ C01}=\frac{R1}{R1+R2+R3}=\frac{R1}{R4} \quad (1)$$

$$\frac{A0\ E02}{A0\ C02}=\frac{R3}{R1+R2+R3}=\frac{R3}{R4} \quad (2)$$

$$\frac{E02\ C02}{A0\ C02}=\frac{R1+R2}{R1+R2+R3}=\frac{R1+R2}{R4} \quad (3)$$

From formula (1) above, the ratio of the value of the resistor $R_1$ to the total value $R_4$ is $$R1=\frac{D01\ C01}{A0\ C01}R4 \quad (4)$$

Similarly, from formula (2) above, the ratio of the value of the resistor $R_3$ to the total value $R_4$ is $$R3=\frac{A0\ E02}{A0\ C02}R4 \quad (5)$$

By substituting formula (3) into formula (4), the ratio of the value of the resistor R to the total resistance R is as follows:

$$\frac{\frac{D01\ C01}{A0\ C01}R4+R2}{R4}=\frac{E02\ C02}{A0\ C02} \quad (6)$$

$$\frac{D01\ C01}{A0\ C01}R4+R2=\frac{E02\ C02}{A0\ C02}R4$$

$$R2=\left(\frac{E02\ C02}{A0\ C02}-\frac{D01\ C01}{A0\ C01}\right)R4$$

The resistance values of the resistors $R_1$, $R_2$ and $R_3$ are found from Formulae (4), (5) and (6) described above. Thus, the potential at the fraction point $D_{01}$ of the voltage $B_0$-$F_0$ between the terminals can be obtained in phase with the voltage across the coil L from the junction D of the resistors $R_1$ and $R_2$ when a coin of the first kind moves past the coil SC. Also, the potential at the fraction point $E_{02}$ of the voltage $B_0$-$F_0$ between the terminals can be obtained in phase with the voltage across the coil L when a coin of the second kind passes the coil SC.

With respect to the second requirement, the voltage between the terminals A and C is reduced by the resistors $R_1$, $R_2$ and $R_3$ and appears at the points D and E. The resultant voltages are then applied to the respective comparison inputs of the amplifiers $AMP_1$ and $AMP_2$ via the resistor $R_{12}$. The reference input terminals of the amplifiers $AMP_1$ and $AMP_2$ are supplied with a potential $G_0$ which is obtained from the voltage between the terminals B and F by the voltage-dividing action of the resistors $r_1$ and $r_2$. The amplifiers $AMP_1$ and $AMP_2$ have amplification factors of $r_{11}/r_{12}$ and $r_{12}/r_{22}$, respectively. The ratio of the resistance $r_{11}$ to the resistance $r_{12}$ is given by:

$$r_{11}/r_{12}=G_0B_0/D_{01}G_0,$$

and the ratio of the resistance $r_{21}$ to the resistance $r_{22}$ is given by:

$$r_{21}/r_{22}=G_0B_0/E_{02}G_0,$$

and $r_{11}=r_{21}$.

As can be understood from the foregoing, when a coin of the first kind moves past the coil SC, the potential $D_{01}$ at the point D between the terminals A and C is made equal to the potential $G_0$ applied to the reference input terminal of the amplifier $AMP_1$ by virtue of its amplification factor $r_{11}/r_{12}$, whereby the output from the amplifier is made zero. Likewise, when a coin of the second kind passes the coil SC, the potential $E_{02}$ at the point E between the terminals A and C is made generally equal with the potential $G_0$ applied to the reference input terminal of the amplifier $AMP_2$ on account of its amplification factor $r_{21}/r_{22}$, thus making the output of the amplifier $AMP_2$ zero.

On the other hand, when no coin is present near the coil SC, the phase of the voltages supplied to the comparison input terminals of the amplifiers $AMP_1$ and $AMP_2$ from the terminals D and E of the arm comprising the resistors $R_1$, $R_2$ and $R_3$ is caused to lag the phase of the voltages, which are developed across the coil L and fed to the reference input terminals of the amplifiers via the voltage-dividing resistors $r_1$ and $r_2$, by virtue of the resistance. As a result, a voltage difference is made between both input terminals of each amplifier, so that each amplifier continues to deliver a nonzero voltage proportional to the difference.

When a coin of the first kind moves past the coil SC, the voltages applied to both input terminals of the amplifier $AMP_1$ are made equal in phase and magnitude, so that the output from the amplifier $AMP_1$ crosses zero level only once. As such, insertion of a coin of the first kind can be determined by the output from the amplifier $AMP_1$. At this time, since the voltages applied to both input terminals of the amplifier $AMP_2$ are out of phase, amplifier $AMP_2$ continues to deliver nonzero output voltage proportional to the phase difference.

When a coin of the second kind passes the coil SC, the voltages applied to both input terminals of the amplifier $AMP_2$ are rendered equal in phase and magnitude and hence the output from the amplifier $AMP_2$ becomes zero once. At this time, the output of the amplifier $AMP_1$ becomes zero twice. The first time it becomes zero is when the coin of the second kind is reaching the position of the coil SC and the reactance of the coil is decreasing. The second time it becomes zero is when the coin is just moving past the coil SC and the reactance is increasing. In this case, insertion of the coin of the second kind can be judged from the output of the amplifier $AMP_2$ by providing a means which sets a coin sorting period to judge coins to be genuine only when a zero value occurs once during the period, as disclosed in Japanese Patent Laid-Open No. 2196/1979 entitled "Coin Sorter."

In the foregoing description, the values of the resistors $r_1$ and $r_2$ which produce a fraction of the voltage across the coil L are held constant, and the amplification factors of the amplifiers $AMP_1$ and $AMP_2$ are set to certain values according to the kinds of coins. Alternatively, the amplification factors of the amplifiers may be set to unity, and the values of the voltage-dividing resistors $r_1$ and $r_2$ may be set according to the kinds of coins. More specifically, the values of the resistors $r_1$, $r_2$ on the respective sides of the reference input terminals of the amplifiers $AMP_1$ and $AMP_2$ are set that:

$$r_1/r_2=F_0D_{01}/D_{01}B_0$$

$$r_1/r_2=F_0E_{02}/D_{02}B_0.$$

Thus, when a coin of the first kind is inserted, the output from the amplifier $AMP_1$ assumes a value of zero only once, and when a coin of the second kind is introduced, the output from the amplifier $AMP_2$ becomes zero only one time, so that coins can be separated into different kinds.

Figure 5:
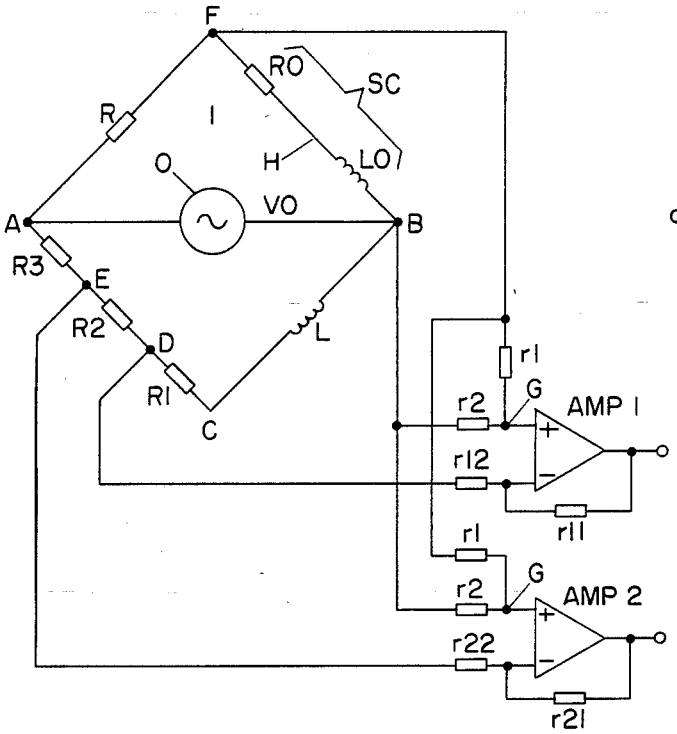
FIG. 5 is a circuit diagram of another embodiment according to the invention.
Figure 6:
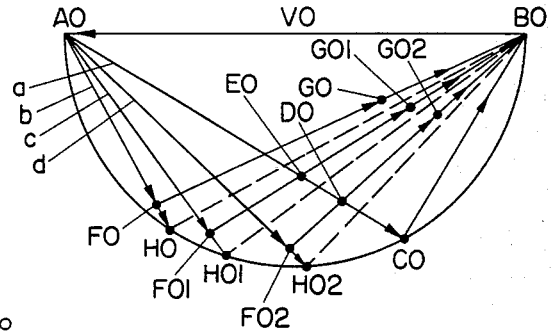
FIG. 6 is a vector diagram illustrating the operation of the FIG. 5 circuit.

An alternate embodiment is shown in FIG. 5, wherein the reactance element is also a fixed coil L, but wherein the arm of the bridge having the fixed coil L is adjacent to the arm of the bridge having the series resistors $R_1$, $R_2$, and $R_3$. FIG. 6 is a vector diagram illustrating the operation of this alternative embodiment.

Vector a composed of Ao - Fo - Bo in FIG. 6 indicates a vector through terminals A, C and B. The potential at terminal C always remains constant, because the values of the fixed resistors $R_1$, $R_2$ and $R_3$, and of the fixed coil L are constant. Vector b composed of Ao - Fo -Bo indicates a vector through terminals A, F and B in a stand-by state where no coin is present near the coin detecting coil SC. The potential at the junction H of the equivalent reactance Lo and the equivalent resistor R of the coin detecting coil SC is indicated by Ho. Go on line segment Bo - Fo indicates a potential at terminal G which is a fraction of the voltage between the terminals B and F divided by the resistors $r_1$ and $r_2$. The line segments Fo - Go and Go - Bo correspond to the resistance ratios of the resistors $r_1$ and $r_2$ respectively. Vector c composed of Ao - Fo1 - Bo indicates a vector through the terminals A, F and B where a coin of a first kind such as a ten-cent coin is present near the coin detecting coil SC, when the potential at ther terminal G changes from Go to Go1. Vector d composed of Ao - Fo2 - Bo indicates a vector through terminals A, F and B in a state where a coin of a second kind such as a twenty-five cent coin is present near the coin detecting coil SC, when the potential at the terminal G changes from Go to Go2.

Point Eo on the vector a intersecting the vector c when a coin of the first kind is placed at the position of the coin detecting coil SC corresponds to the potential at the terminal E in FIG. 5, and the point Eo on the vector a means that the voltage produced across the coin detecting coil SC between the eterminals B and F and the voltage across the terminals B and E of the series circuit composed of the fixed coil L and the resistors $R_1$ and $R_2$ are in phase, although the terminal voltage across the terminals B and F and the terminal voltage across the terminals B and E are different in amplitude. Further, the point Do on the vector a intersecting the vector d when a coin of the second kind is present near the coin detecting coil SC corresponds to the potential at the terminal D in FIG. 5 and the point Do on the vector a means that the terminal voltage produced across the coin detecting coil SC between the terminals B and F and the terminal voltage for the series circuit composed of the fixed coil L and the resistor $R_1$ between the terminals B and D are phase, although the terminal voltage between terminals B and F and the terminal voltage between the terminals B and D are different in amplitude. Therefore, the differential amplifiers $AMP_1$ outputs a zero signal, that is, a genuine coin signal by dividing the point Eo to the point Go1 on the vector a when a coin of the first kind is present near the coin detecting coil SC, while the differential amplifier $AMP_2$ outputs a zero signal, that is, a genuine coin signal by dividing the point Do to the point Go1 on the vector a when the coin of the second kind is near the coin detecting coil SC. Consequently, in this embodiment, the differential amplifier $AMP_1$ outputs a genuine coin signal when a coin of the first kind is deposited and the differential amplifier $AMP_2$ outputs a genuine coin signal when a coin of the second kind is deposited by defining the ratio for each of the resistance values of the resistors $R_1$, $R_2$ and $R_3$ as:

$$R_1 : R_2 : R_3=CoDo : DoEo : EoAo,$$

the resistance ratio between the resistors $r_{11}$ and $r_{12}$ with respect to the differential amplifer $AMP_1$ as:

$$r_{11}/r_{12}=EoGo1/Go1Bo, \text{ and}$$

the resistance ratio between the resistors $r_{11}$ and $r_{12}$ with respect to the differential amplifier $AMP_1$ as:

$$r_{11}/r_{12}=EoGo1/Go1Bo, \text{ and}$$

the resistance ratio between the resistors $r_{21}$ and $r_{22}$ with respect to the differential amplifier $AMP_2$ as:

$$r_{21}/r_{22}=DoGo2/Go2Bo.$$

Figure 7:
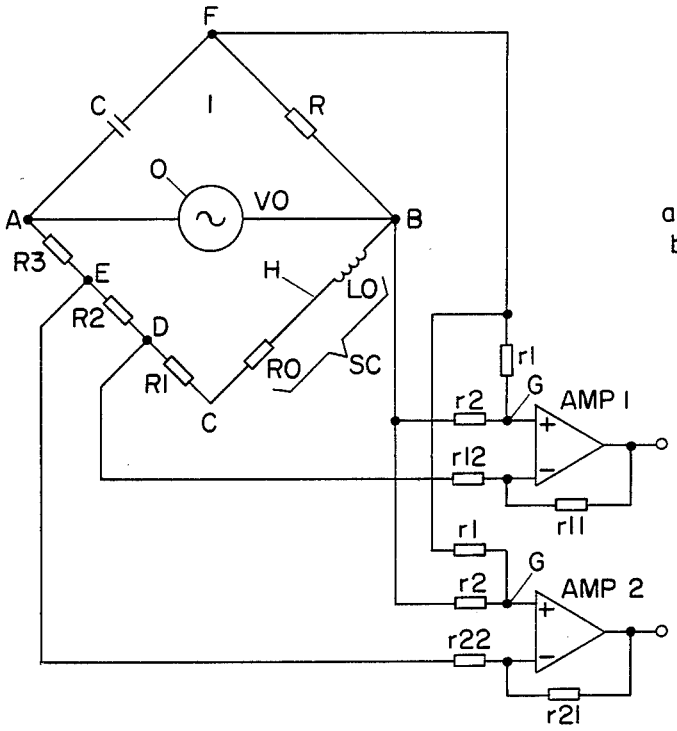
FIG. 7 is a circuit diagram of yet another embodiment according to the invention.
Figure 8:
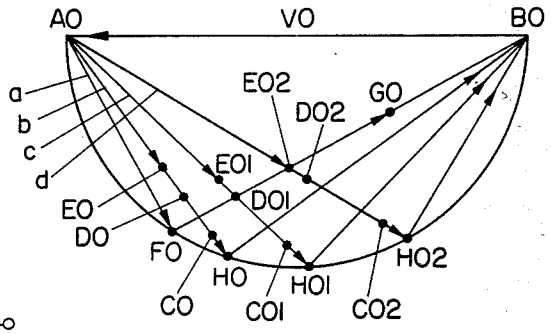
FIG. 8 is a vector diagram illustrating the operation of the FIG. 7 circuit.

Another alternate embodiment is shown in FIG. 7, wherein the reactance element is a fixed reference capacitor C instead of a fixed coil. The arm of the bridge having the reactance element is adjacent the arm of the bridge having the series resistors. FIG. 8 is a vector diagram illustrating the operation of this alternative embodiment.

In FIG. 7, a terminal voltage across the reference register R is applied while being divided by the resistors $r_1$, and $r_2$ to each of the reference input terminals of the differential amplifiers $AMP_1$ and $AMP_2$. When an AC voltage of a predetermined frequency is applied between the terminals A and B in this embodiment, a vector through the terminals A, F and B forms a vector a composed of Ao - Fo - Bo shown in FIG. 8. As apparent from the comparison between FIG. 8 and FIG. 4, the operation and the effect obtained from the embodiment shown in FIG. 7 are the same as that shown in FIG. 3. Consequently, the differential amplifier $AMP_1$ outputs a genuine coin signal when a coin of the first kind is deposited and the differential amplier $AMP_2$ outputs a genuine coin signal when a coin of the second kind is deposited by selecting each of the resistance values for the resistors $R_1$, $R_2$, $R_3$, $r_1$, $r_2$, $r_{11}$, $r_{12}$, $r_{21}$ and $r_{22}$ in the same manner as in the embodiment shown in FIG. 3.

It should be understood that in the foregoing description coins are separated into two kinds for simplicity. It is possible, however, to separate coins into more than two kinds by providing additional resistors between the terminals A and C according to the number and type of additional coins desired to be detected.

As described hereinbefore, such a coin sorter is provided in accordance with the invention that has an AC bridge circuit including one arm that comprises a detecting coil disposed along a coin passage to detect a plurality of kinds of coins for sorting the coins. According to the invention, coins can be separated into a plurality of types of a single AC bridge circuit without the necessity of semi-bridge circuit, whereby the output from the oscillator can be held at a low level. Further, because the apparatus is lightly loaded, and because signals are derived from the junctions of the fixed resistors, a stable characteristic is obtained and operating waveforms are not distorted. Furthermore, each of the aforementioned fixed resistors is set to a single value corresponding to the characteristics of accepted coins, thus dispensing with tedious adjustment and calibration. However, it should be noted that each of the aforementioned fixed coils and fixed resistors can instead be variable to thereby facilitate fine adjustment if desired.

From the foregoing, it will be observed that numerous variations and modifications may be effected without departing from the true spirit and scope of the novel concept of the invention. It is to be understood that no limitation with respect to the specific embodiments illustrated here is intended or should be inferred. It is, of course, intended to cover by the appended claims all such modifications as fall within the scope of the claims.

We claim:

1. A coin sorter for detecting a plurality of denominations of coins which roll along a coin passage, comprising:

an AC bridge circuit having a detecting coil in a first bridge arm positioned along said coin passage, a reactance element in a second bridge arm, and a plurality of resistors connected in series in a third bridge arm for obtaining fractions of the voltage developed across said third arm in response to the different coins;

differential amplifiers circuits associated with the different coins and connected to receive voltage signals from different taps between said resistors, and to compare the voltages obtained with a voltage proportional to the voltage developed across the reactance element;

and wherein said resistor values, reactance element value and differential amplifier circuit amplification factors are selected so that said differential amplifiers produce output signals respectively indicating the different coin denominations.

2. The coin sorter according to claim 1, wherein the reactance element is a fixed coil.

3. The coin sorter according to claim 1, wherein the reactance element is a capacitor.

4. The coin sorter according to claim 1, wherein the second arm having the reactance element is opposite the third arm having the series resistors.

5. The coin sorter according to claim 1, wherein the second bridge arm having the reactance element is adjacent the third arm having the series resistors.

6. The coin sorter according to claim 1, which further comprises:

an oscillator for applying an AC voltage of a constant frequency to said AC bridge circuit.

* * * * *